US010988868B2

(12) United States Patent
Mittal et al.

(10) Patent No.: US 10,988,868 B2
(45) Date of Patent: Apr. 27, 2021

(54) TEXTILE STRUCTURES COMPRISING CORE SPUN YARNS AND ASSOCIATED METHODS FOR MANUFACTURE

(71) Applicant: Sysco Guest Supply, LLC, Somerset, NJ (US)

(72) Inventors: Khushboo Mittal, Somerset, NJ (US); Mohan Kandhasamy, Somerset, NJ (US)

(73) Assignee: Sysco Guest Supply, LLC, Somerset, NJ (US)

( * ) Notice: Subject to any disclaimer, the term of this patent is extended or adjusted under 35 U.S.C. 154(b) by 42 days.

(21) Appl. No.: 14/664,029

(22) Filed: Mar. 20, 2015

(65) Prior Publication Data

US 2016/0273135 A1 Sep. 22, 2016

(51) Int. Cl.

| | |
|---|---|
| ***D03D 15/00*** | (2021.01) |
| ***D03D 1/00*** | (2006.01) |
| ***D03D 15/47*** | (2021.01) |
| ***D03D 11/00*** | (2006.01) |
| ***D02G 3/36*** | (2006.01) |
| ***D03D 15/49*** | (2021.01) |

(52) U.S. Cl.

CPC ..... *D03D 15/47* (2021.01); *D02G 3/36* (2013.01); *D03D 1/0017* (2013.01); *D03D 11/00* (2013.01); *D03D 15/49* (2021.01); *D10B 2201/02* (2013.01); *D10B 2201/24* (2013.01); *D10B 2503/06* (2013.01)

(58) Field of Classification Search

None

See application file for complete search history.

(56) References Cited

U.S. PATENT DOCUMENTS

| | | | | |
|---|---|---|---|---|
| 3,889,028 | A | 6/1975 | Hosterey et al. | |
| 4,191,221 | A * | 3/1980 | Boyer | D02G 3/36 139/426 R |
| 4,352,380 | A | 10/1982 | Owen et al. | |
| 6,666,235 | B2 | 12/2003 | Chi et al. | |
| 7,155,891 | B2 | 1/2007 | Bader | |

(Continued)

FOREIGN PATENT DOCUMENTS

| | | | |
|---|---|---|---|
| CN | 1532313 | A | 9/2004 |
| CN | 203187865 | U | 9/2013 |

(Continued)

OTHER PUBLICATIONS (http://www.luxuryegyptiancotton.com/resources/thread-count-basics.html,"Thread Count Basics", Apr. 7, 2004, page visited on Dec. 1, 2017). (Year: 2004).*

(Continued)

*Primary Examiner* — Shawn McKinnon

(74) *Attorney, Agent, or Firm* — Bracewell LLP; Brad Y. Chin; Vivek P. Shankam

(57) ABSTRACT

Embodiments described herein generally relate to textile structures comprising core spun yarns, and associated methods for manufacturing. One example embodiment is a textile structure including one or more layers of warp yarns interwoven with one or more layers of weft yarns, wherein at least one of the one or more layers of warp yarns and one or more layers of weft yarns include one or more core spun yarns.

22 Claims, 7 Drawing Sheets

(56) References Cited

U.S. PATENT DOCUMENTS

| | | | | |
|---|---|---|---|---|
| 7,201,024 | B2 | 4/2007 | Hirayama et al. | |
| 9,677,201 | B2 | 6/2017 | Mandawewala | |
| 9,677,202 | B2 | 6/2017 | Mandawewala | |
| 9,677,205 | B2 | 6/2017 | Mandawewala | |
| 10,072,364 | B2 | 9/2018 | Goenka | |
| 2004/0166143 | A1 | 8/2004 | Last et al. | |
| 2005/0055997 | A1* | 3/2005 | Bader | D02G 3/367 57/224 |
| 2006/0179810 | A1 | 8/2006 | Liao | |
| 2008/0318485 | A1* | 12/2008 | Cheng | D01H 1/02 442/182 |
| 2009/0317584 | A1 | 12/2009 | Ivanoff et al. | |
| 2010/0037658 | A1 | 2/2010 | Susa et al. | |
| 2011/0092119 | A1* | 4/2011 | Cliver | D06M 13/422 442/143 |
| 2013/0040523 | A1 | 2/2013 | Masanobu et al. | |
| 2013/0101781 | A1† | 4/2013 | Lee | |
| 2013/0183495 | A1 | 7/2013 | Rock | |
| 2014/0308865 | A1 | 10/2014 | Kumar et al. | |
| 2015/0093538 | A1 | 4/2015 | Ivanoff et al. | |
| 2015/0167210 | A1 | 6/2015 | Tomlin | |
| 2015/0176160 | A1 | 6/2015 | Lee et al. | |
| 2016/0160406 | A1* | 6/2016 | Agarwal | D03D 15/08 139/421 |
| 2017/0342609 | A1 | 11/2017 | Mandawewala | |
| 2018/0347080 | A1 | 12/2018 | Goenka et al. | |
| 2019/0093264 | A1 | 3/2019 | Erickson et al. | |
| 2019/0194841 | A1 | 6/2019 | Mittal et al. | |
| 2020/0040491 | A1 | 2/2020 | Mittal et al. | |

FOREIGN PATENT DOCUMENTS

| | | | |
|---|---|---|---|
| CN | 20333924 | U | 12/2013 |
| CN | 103966720 | A | 8/2014 |
| CN | 203834094 | U | 9/2014 |
| CN | 104278590 | A | 1/2015 |
| CN | 105442088 | A | 3/2016 |
| EP | 3385025 | B1 | 9/1990 |
| EP | 3425075 | B1 | 5/1991 |
| EP | 1302577 | B1 | 4/2003 |
| EP | 1354085 | B1 | 10/2003 |
| EP | 1542558 | B1 | 6/2005 |
| EP | 1819856 | B1 | 8/2007 |
| EP | 1846602 | B1 | 10/2007 |
| EP | 2496743 | B1 | 9/2012 |
| GB | 893766 | | 4/1962 |
| JE | 102013101470 | A1 | 8/2014 |
| WO | 03038169 | A1 | 5/2003 |
| WO | 2008048256 | A2 | 4/2008 |
| WO | 2014113207 | A1 | 7/2014 |

OTHER PUBLICATIONS

P. Pramanik, Vilas. M. Patil, "Physical Characteristics of Cotton/Polyester Core Spun Yard Made Using Ring and Air-Jet Systems," AUTEX Research Journal, vol. 9, No. 1, Mar. 2009, Faculty of Textile, S.G.G.S. Institute of Engineering & Technology, Nanded, Maharashtra, India.

Safieh Doakhan, S. Abdolkarim Hosseini Ravandi, Aliakbar Gharehaghaji, S. Majid Mortazavi, "Capillary Rise in Core-spun Yarn," Iranian Polymer Journal 16 (6), 2007, 397-408, Textile Engineering Department, Isfahan University of Technology, Isfahan.

A. P. S. Sawhney, G. F. Ruppenicker, "Special Purpose Fabrics Made With Core-Spun Yarns," Indian Journal of Fibre & Textile Research, vol. 22, Dec. 1997, pp. 246-254, Southern Regional Research Center, Agricultural Research Service, U.S. Department of Agriculture, New Orleans, LA, USA.

A&E Technical Bulletin entitled "Corespun Versus Spun Poly Threads," 6 pp., date printed Jan. 26, 2015.

Extended European Search Report for European Application No. 16206469.5; Report dated Jun. 30, 2017 (pp. 1-8).

International Search Report and Written Opinion for International Application No. PCT/US5017/024311, report dated Nov. 28, 2017; pp. 1-22.

* cited by examiner
† cited by third party

300

Core spun Thread

| Tex Size | T-18 | T-24 | T-30 | T-40 | T-40 | T-60 | T-80 | T-120 |
|---|---|---|---|---|---|---|---|---|
| Yarn Size | 59/2 | 45/2 | 35.2 | 29/2 | 18/2 | 15/2 | 12/2 | 15/3 |
| Av. Strength(lbs) | 2.1 | 2.7 | 3.5 | 4.5 | 7.8 | 9 | 10.6 | 13.51 |
| Elongation (% at break) | 21.5 | 20.5 | 21.5 | 21.5 | 24.2 | 24.8 | 26.3 | 25.7 |
| Shrinkage (BW) | <1% | <1% | <1% | <1% | <1% | <1% | <1% | <1% |
| Shrinkage (HA) | <3% | <3% | <3% | <3% | <3% | <3% | <3% | <3% |
| Loop Strength (lbs) | 2.7 | 4.0 | 5.2 | 6.3 | 11.6 | 13.3 | 15.8 | 20.5 |

Spun Polyester Thread

| Tex Size | T-21 | T-27 | T-40 | T-60 | T-80 | T-105 | T-120 |
|---|---|---|---|---|---|---|---|
| Yarn Size | 53/2 | 43/2 | 29/2 | 19/2 | 14/2 | 16/3 | 16/4 |
| Av. Strength(lbs) | 1.6 | 2.1 | 3.2 | 4.7 | 7.1 | 9.7 | 10.6 |
| Elongation (% at break) | 16.1 | 16.3 | 17.0 | 18.0 | 18.6 | 19.9 | 18.5 |
| Shrinkage (BW) | <1% | <1% | <1% | <1% | <1% | <1% | <1% |
| Shrinkage (HA) | <3% | <3% | <3% | <3% | <3% | <3% | <3% |
| Loop Strength (lbs) | 2.7 | 3.1 | 4.8 | 7.9 | 11.3 | 15.1 | 16.9 |

FIG. 6

| | Corespun (50/50) | Intimate Blend (50/50) | 100% Cotton |
|---|---|---|---|
| Yarn Strength (kgf) | 87 | 60.9 | 45.9 |
| Tensile Break Strength (kgf) | 59.1 | 42.3 | 29.1 |
| Tensile Break elongation (%) | 24.2 | 19.9 | 13.2 |
| Tongue Tear Strength (kgf) | 4.32 | 3.23 | 1.54 |

FIG. 7

TEXTILE STRUCTURES COMPRISING CORE SPUN YARNS AND ASSOCIATED METHODS FOR MANUFACTURE

TECHNICAL FIELD

Embodiments described herein generally relate to textile structures comprising core spun yarns and associated methods for manufacturing. More specifically, example embodiments relate to textile structures used in institutional and hospitality linen areas.

BACKGROUND

Conventional fabrics for use on or against the skin, such as sheets, pillow cases, undershirts, sleeves, gowns, shirts, and the like may be cut and formed from sheeting comprised of warp end yarns and fill pick yarns woven into a web. Selection of yarn for such sheeting often involves a compromise between hand or "feel" and durability. For example, where the yarns are all-natural, 100% cotton, the resultant sheet has a hand that is desirably comfortable and pleasing to the user. However, 100% cotton fabrics do not wear well nor do they readily survive the sometimes harsh laundering procedures to which they may be exposed, especially in commercial or industrial applications such as encountered in connection with hospitals, rest homes, clinics, hotels and the like. In this regard, such fabrics must be able to withstand about 100 to 250 institutional laundry cycles of high temperature or caustic washing, drying, ironing and possibly even steam sterilization.

Similarly, where the web is woven from all synthetic filament yarns, a very durable product is formed, but it suffers from a relatively low hand (i.e., rough feel) that detracts from the web's utility for use on or against the skin.

Various conventional approaches to achieve a balance between durability and hand have been proposed. By way of example, woven sheeting comprised of yarns which are intimately blended spun fibers, which may be all natural or a blend of natural and synthetic, may not have the desired hand or durability and can be limited by the nature of the spun fiber. In some cases, spun fiber strands and filament strands are twisted into yarns to provide greater durability. While the durability is increased, the twisted yarns have some drawbacks including that they may adversely affect the hand of the resultant web. Others have proposed to use separate, alternating adjacent ends or picks of natural yarns of different character, such as cotton and silk (U.S. Pat. No. 776,275) or mohair and silk (U.S. Pat. No. 1,139,705) in a given weave direction. The latter also suggested use of artificial silk, which is believed to have been a reference to rayon or similar cellulosic (i.e., cotton) material, and so was still a natural yarn. These silk-based approaches are not believed to provide a cost-effective and desired balance of hand and durability necessary for fabrics used on or against the skin.

Conventional sheeting fabrics from which fine luxury bed sheets and pillowcases can be produced may be characterized by a plain weave construction of a high thread count of at least about 100 threads per square inch. Formerly, percale sheets were formed from 100 percent cotton fibers, but today nearly all percale sheets are of the permanent press type and formed of a blend of polyester and cotton fibers, with the cotton usually comprising about half but sometimes as little as 35 percent of the weight of the fabric.

The polyester fibers are included in the polyester and cotton blend sheeting fabric to reduce cost and to improve the strength, durability, dimensional stability, and wash and wear performance of the fabric. However, because of the reduced amount of cotton fiber, the polyester and cotton blend sheeting fabrics generally have a less luxurious appearance and feel than all cotton sheeting fabrics, and are less absorbent and consequently less comfortable than all cotton sheeting fabrics.

SUMMARY

Embodiments of the disclosure can include textile structures comprising core spun yarns and associated methods for manufacturing.

One example embodiment provides a sheeting fabric having certain physical and aesthetic characteristics which are more luxurious than and superior to the characteristics of the fiber blend sheeting fabrics which are presently known.

Another example embodiment can provide a sheeting fabric which more effectively utilizes the beneficial properties of the core spun yarns as compared to conventional polyester and cotton blend fabric constructions so as to provide quick dry properties. This property may be specifically important in the hospitality industry as it may result in reduced drying time and reduced energy usage.

Another example embodiment provides a sheeting fabric with high temperature resistance and better dimensional stability because of 100% cotton coverage on the surface of the fabric, which provides insulation to heat.

Another example embodiment provides a sheeting fabric with 100% cotton coverage on the surface of the fabric such that all the fibers that comes in contact with skin are cotton, giving the sheeting fabric a great feel and comfort.

These and other embodiments can be accomplished by providing a unique sheeting fabric construction in which the core spun yarns are located at the surface of the fabric for improved hand with the cotton sheath of the core spun yarns being on the outside surface and improved physical characteristics with synthetic filaments such as polyester fibers being located in the core of the yarns to give strength and durability to the fabric.

More particularly, the sheeting fabric of certain example embodiments can be formed of warp and/or filling yarns of core spun construction with each of the core spun warp and filling yarns having a core portion of multifilament polyester and a sheath portion formed of staple fibers helically wrapped about the multifilament polyester core portion to substantially surround and encase the multifilament polyester core.

The staple fibers which form the sheath portion of the yarns may be either cotton or rayon and comprise at least 60 percent by weight of the core spun yarn. The core spun warp or filling yarns may have a yarn count of about 8-60 Ne and may be interwoven to form a closely woven fabric of at least about 120 threads per square inch or higher, for example, 160 threads per inch to about 400 threads per inch, and wherein the picks per inch may be at least 10 percent less than the warp ends per inch.

This unique construction for a sheeting fabric can provide a number of properties not otherwise obtainable in conventional polyester and cotton blend sheeting fabrics. Sheeting fabrics constructed in accordance with certain example embodiments can have an all staple fiber surface which provides a number of desirable aesthetic and functional properties, while the polyester core gives strength and durability to the fabric.

The fabric can exhibit noticeably better feel and comfort than conventional polyester and cotton blend sheeting fabrics. This property is largely due to the fact that the staple fiber is located at the surface of the fabric, which takes advantage of the natural "bloom" or cover that the fiber develops during wet finishing. The unique structure of cotton fibers can also contribute to the enhancement of the cover factor. In this regard, cotton fibers have an irregularly shaped cross section as compared to the polyester fibers used in sheeting. The presence of these irregularly shaped fibers at the surface of the fabric can enhance the cover factor of the fabric. In addition, the natural twists or convolutions inherent in a cotton fiber, which may average at least 125 twists per inch, also contribute to the improved cover factor.

Sheeting fabrics formed of core spun yarns in accordance with certain example embodiments can have a rate of moisture absorbency that is significantly higher than that of conventional cotton and polyester blend sheeting fabrics. This can enable the fabric to wick moisture away from the body much more rapidly, thereby providing a greatly enhanced comfort factor. This relatively higher rate of absorbency is due to the fact that the hydrophilic staple fibers are located on the surface of the fabric, thus allowing better utilization of the beneficial hygroscopic properties of the staple fiber than is the case in conventional polyester and cotton blend sheeting fabric where the cotton fibers are uniformly blended throughout the yarn structure, with many of the cotton fibers thus being buried within the yarns.

BRIEF DESCRIPTION OF THE DRAWINGS

All aspects and features of certain example embodiments of the present disclosure will be more apparent from the following description taken in conjunction with the accompanying drawings, in which:

FIG. 6 is a table comparing characteristics of an example core spun yarn with spun polyester thread, according to one or more example embodiments; and FIG. 7 is table comparing characteristics of an example core spun yarn with an intimate blend yarn, and a 100% cotton yarn, according to one or more example embodiments.

The following description and the drawings sufficiently illustrate specific embodiments to enable those skilled in the art to practice them. Other embodiments may incorporate structural, process, and other changes. Portions and features of some embodiments may be included in, or substituted for, those of other embodiments. Details of one or more implementations are set forth in the accompanying drawings and in the description below. Further embodiments, features, and aspects will become apparent from the description, the drawings, and the claims. Embodiments set forth in the claims encompass all available equivalents of those claims.

DETAILED DESCRIPTION

Example embodiments described herein can provide textile structures comprising core spun yarns and associated methods for manufacturing.

One example embodiment is a textile structure including one or more layers of warp yarns, and one or more layers of weft yarns interwoven with the one or more layers of warp yarns, wherein at least one of the one or more layers of warp yarns and one or more layers of weft yarns including one or more core spun yarns.

Another example embodiment is a method for manufacturing a textile structure including providing one or more layers of warp yarns, and weaving one or more layers of weft yarns with the one or more layers of warp yarns, wherein at least one of the one or more layers of warp yarns and one or more layers of weft yarns include one or more core spun yarns.

Another example embodiment is a woven fabric including a plurality of warp yarns, and a plurality of weft yarns interwoven with the plurality of warp yarns, wherein at least one of the plurality of warp yarns and the plurality of weft yarns include one or more core spun yarns.

Figure 1:
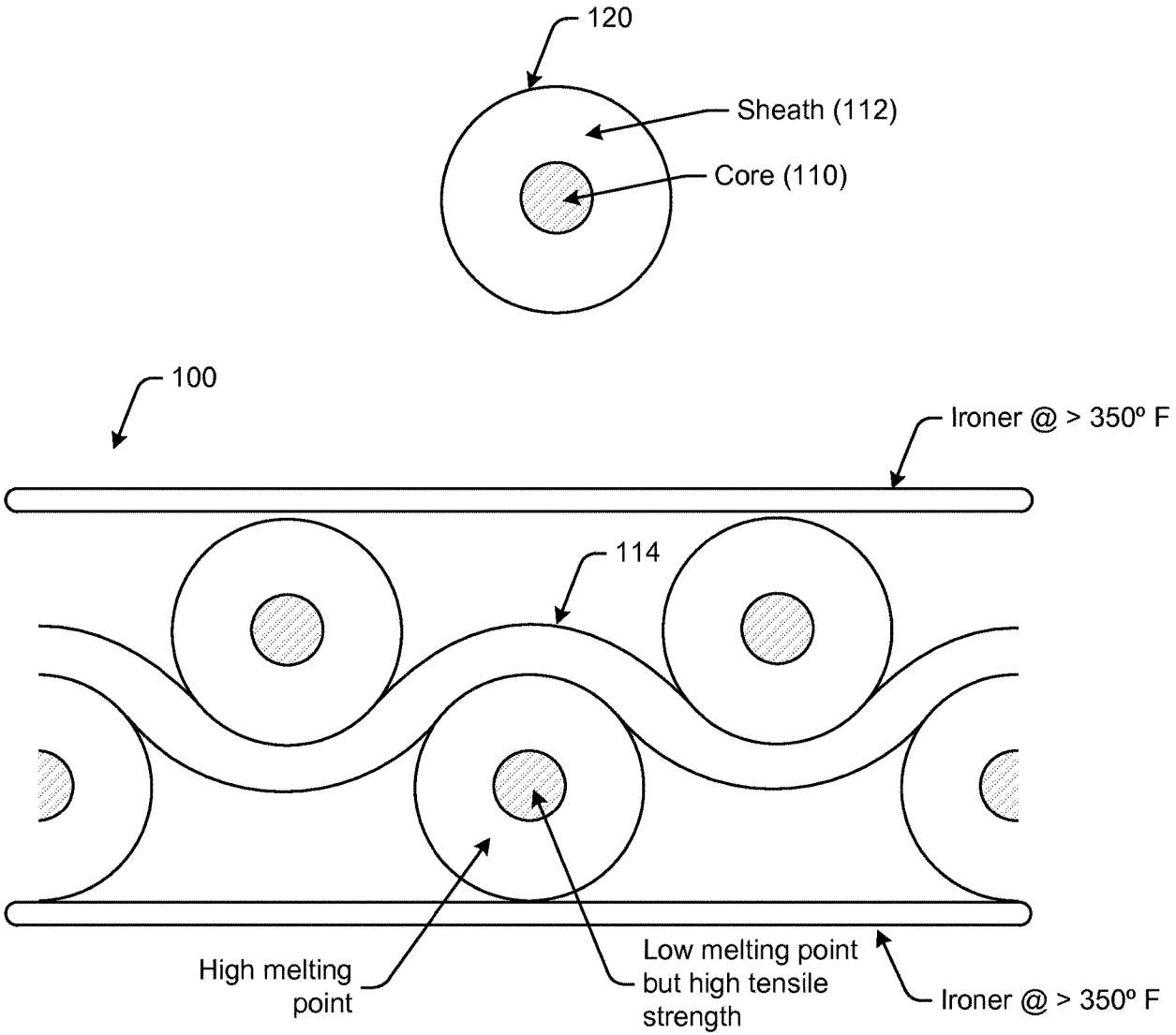
FIG. 1 is an illustrative view of a sheeting fabric formed in accordance with one or more example embodiments.

Turning now to the figures, FIG. 1 illustrates a textile structure 100 according to one or more example embodiments of the present disclosure. Textile structure 100 may include one or more layers of warp yarns, and one or more layers of weft yarns, which may be interwoven with the one or more layers of warp yarns, as shown in FIG. 1, for example. Weave patterns may include plain, twill, twill stripe, satin, sateen, or any combinations thereof. Textile structure 100 may be a single layer fabric or a multi-layer fabric including more than one layer of warp and weft yarns. As illustrated in FIG. 1, an example manner in which core spun weft and warp yarns may be interwoven, at least one of the one or more layers of warp yarns and one or more layers of weft yarns may include one or more core spun yarns 120. For example, core spun yarns 120 may be in the warp direction or weft direction, or in both warp and weft directions. In one example embodiment, textile structure 100 may include weft yarns 114, which may be natural or synthetic fiber yarns, such as for example, cotton or polyester. The warp yarns, the weft yarns, or the core spun yarns may have a yarn density of about 8 to 60 Ne. The warp yarns, the weft yarns, or the core spun yarns may include single or multiple ply yarns.

As illustrated in FIG. 1, core spun yarns 120 may include a core 110 and a sheath 112 that may partially or entirely cover the core portion 110. Textile structure 100 may be exposed to temperatures as high as 300° F. or even higher during ironing, and during this process, a high melting point sheath 112 may protect the low melting point core 110 from thermal degradation. Core portion 110 may be made of synthetic materials such as polyester, which may have high tensile strength, but low melting point when compared to natural materials like cotton, which tends to have a high melting point. The denier count for the core portion 110 can be between 15 and 112 denier, and preferably between 20 and 45 denier.

Figure 2:
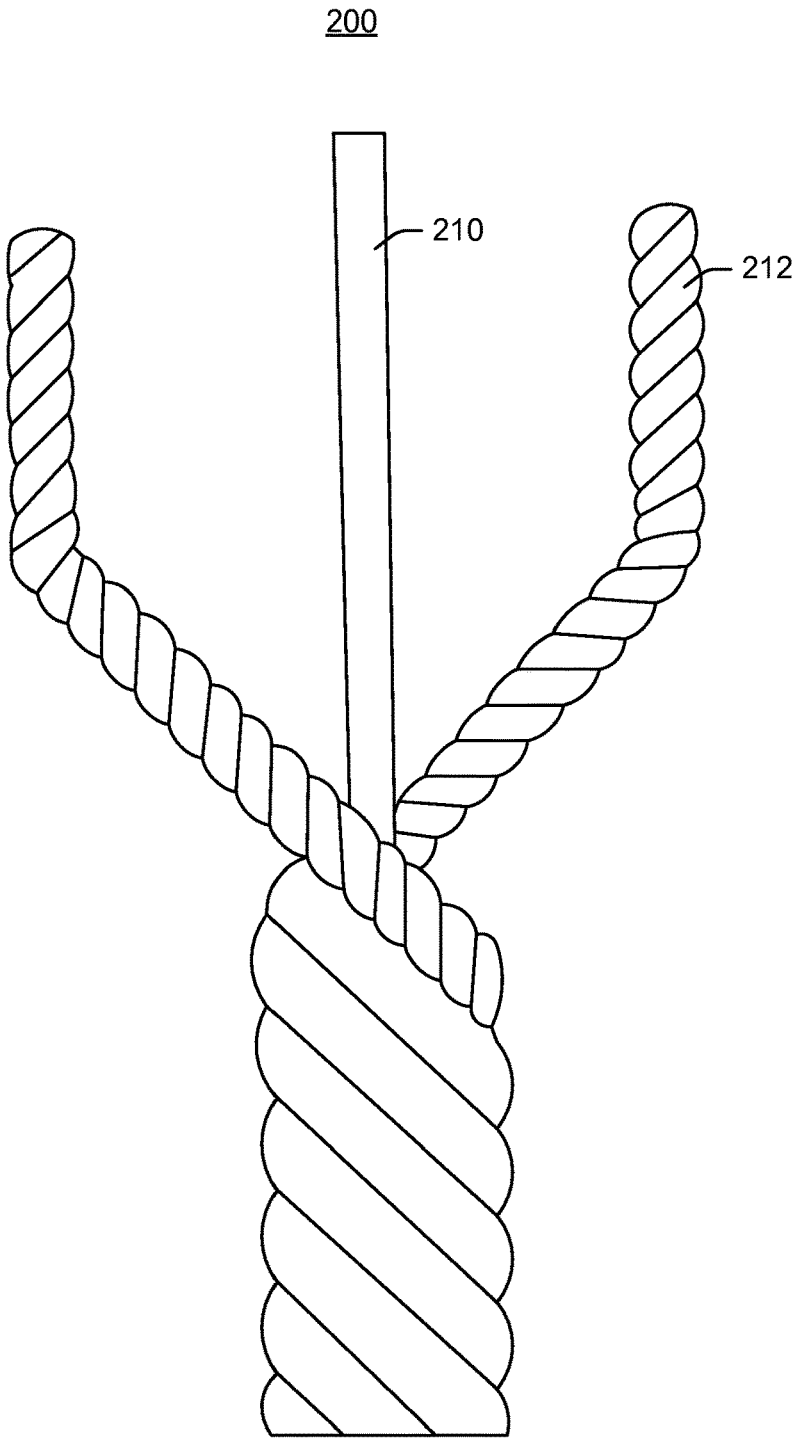
FIG. 2 is a cross-sectional view of a core spun yarn, according to one or more example embodiments.

FIG. 2 is a cross sectional view of a core spun yarn 200, which may be used as warp yarn in the textile structure 100, as illustrated in FIG. 1, for example. One or more core spun yarns 200 may include a sheath portion 212 and a core portion 210. The sheath portion 212 may include natural yarns, man-made yarns, or blended yarns, although natural fibers such as cotton can also be used. The core portion 210 may include natural yarns, man-made yarns, or blended yarns, although synthetic yarns such as polyester can also be used. The man-made yarns may include filament yarns or spun yarns. The filament yarns may include textured or un-textured yarns. The denier count for the core portion 210 can be between 15 and 112 denier, and preferably between 20 and 45 denier In one example embodiment, the textile structure may include core spun yarns in the range of about 40-60% by weight. In one example embodiment, the core spun yarns may include about 20% by weight polyester in the core portion and about 80% by weight of man-made, natural or blended sheath portion. In one example embodiment, the textile structure may include only polyester yarns in the weft direction. In another example embodiment, the textile structure may include only polyester yarns in warp direction, and the core spun yarns in the weft direction, either alone or in combination with polyester yarns or cotton yarns, which may be alternated with the core spun yarns in any proportion.

Core spun yarns 200 may be produced on a spinning frame in a manner known in the art. The staple fiber roving may be processed through a conventional drafting system on a standard cotton system spinning frame. The polyester filament yarn may be introduced to the middle of the flow of cellulosic fiber stock just behind the front roll of the drafting system. By this means, the polyester filament yarn is not drafted but simply pulled under the nip of the front roll with the staple fibers. Then, since the polyester yarn 210 is a continuous strand, it is held in place between the nip of the front roll and the spindle, and as a result becomes the core or center of the yarn as the staple fibers are twisted around the filament core to form the outer sheath 212 of the yarn 200.

For the staple fiber sheath portion 212 of the core spun yarn 200, either cotton or rayon roving is used at the spinning frame to wrap the polyester filament core 210. In a cotton and polyester core spun yarn, roving of 100 percent combed cotton fibers may be employed. To provide uniform coverage of the polyester filament core, the cotton fibers should have a staple length of at least about 1 1/16 inch, for example.

Figure 3:
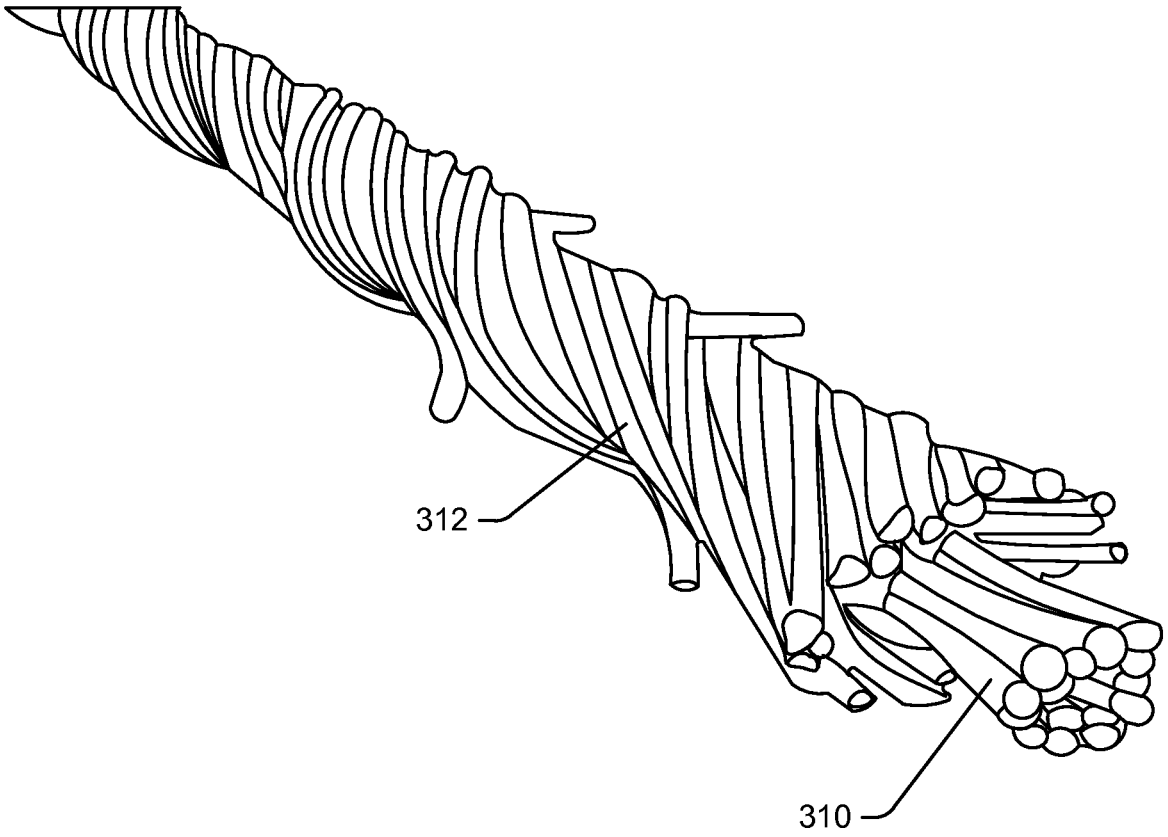
FIG. 3 is a schematic of a core spun yarn, according to one or more example embodiments.

Turning now to FIG. 3, illustrated is a schematic of a core spun yarn 300, according to one or more example embodiments. The core portion 310 of the core spun yarn 300 may be formed of continuous filament polyester yarn. The denier count for the core portion 310 can be between 15 and 112 denier, and preferably between 20 and 45 denier. The polyester filament core may be a multifilament yarn as opposed to a monofilament yarn, with a sufficiently low denier per filament so as to maintain suppleness and pliability to the yarn and in turn to the woven fabric itself. Multifilament polyester yarn of two to four denier per filament may provide a desirable level of suppleness and pliability to the yarn and fabric. It is desirable to have the minimum amount of twist in this polyester filament yarn so as to provide a smooth surface for the even application of the sheath fibers 312.

Figure 4:
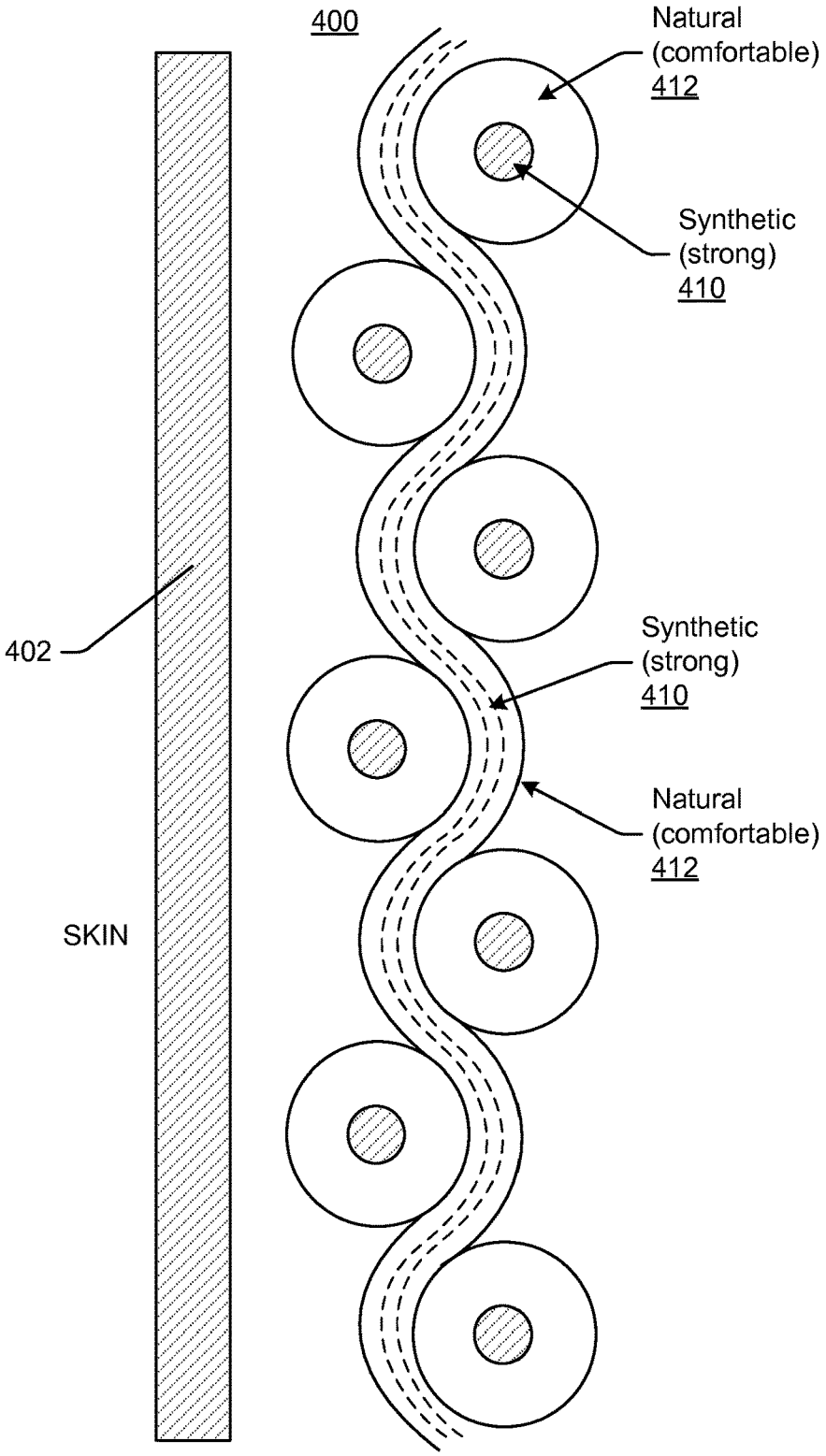
FIG. 4 is an illustrative view of a sheeting fabric formed in accordance with one or more example embodiments.

FIG. 4 illustrates an example use case where fabric 400 may be in contact with the skin 402, according to one or more example embodiments. In this example, core spun yarns may be used in both the warp and weft directions in the fabric 400. As illustrated in FIG. 4, the core spun yarns may include a natural, comfortable, sheath portion 412 and a synthetic, strong, portion 410. Although a plain weave is illustrated, the fabric 400 may be woven using any weave known to one of skill in the art, including but not limited to twill, satin, or sateen.

Figure 5:
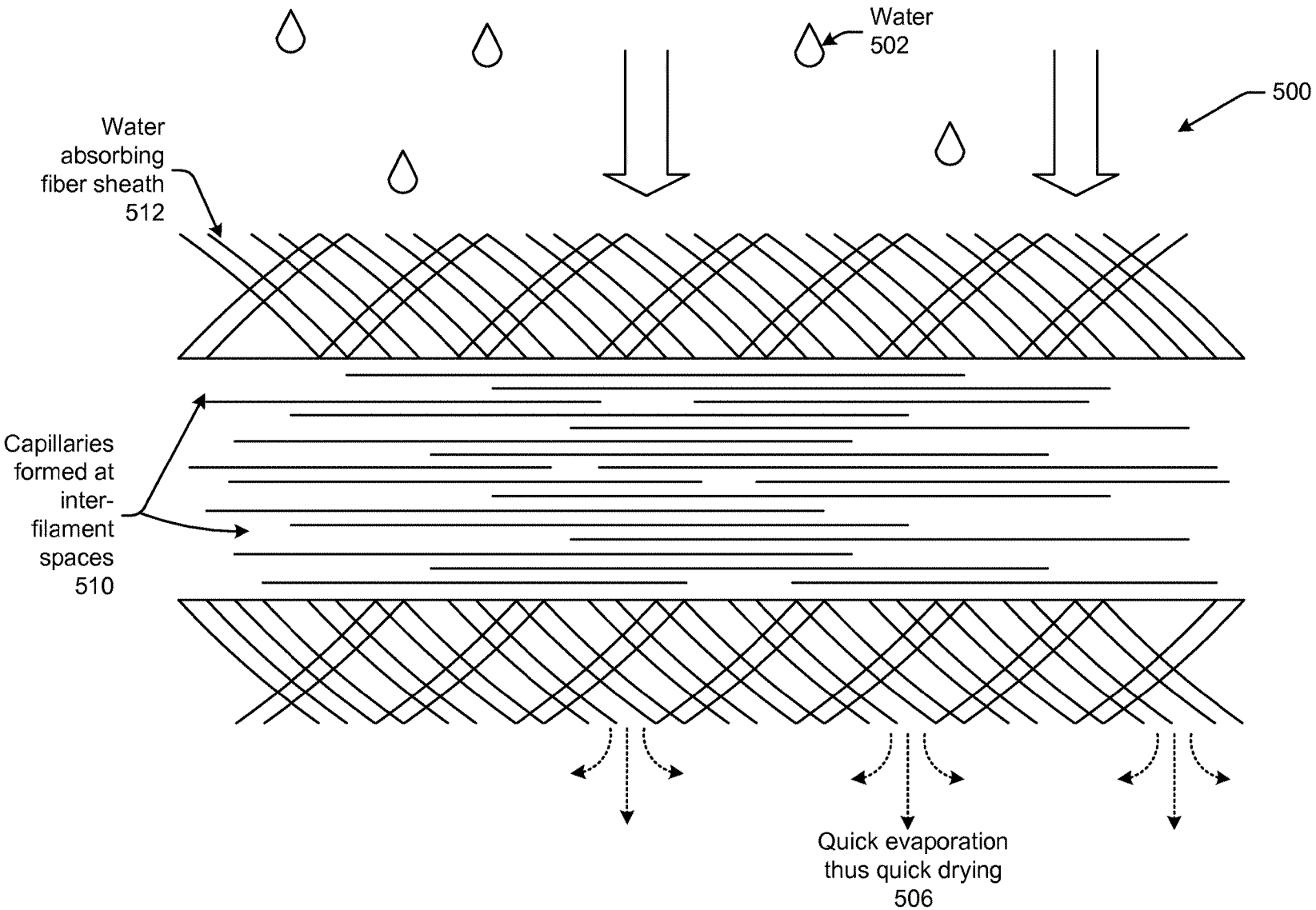
FIG. 5 is an illustrative cross-sectional view of a sheeting fabric formed in accordance with one or more example embodiments.

FIG. 5 illustrates another example use case where water 502 entering fabric 500 may quickly evaporate due to the capillaries formed at the inter-filament spaces in the core 510 and the water absorbing sheath 512, thus resulting in a quick drying process. Fabric 500 may include core spun yarns in both the warp and/or weft directions, for example. As illustrated in FIG. 5, the core spun yarns may include a natural, comfortable, sheath portion 512 and a synthetic, strong, portion 510. Quick drying in fabric 500 may result in significant savings in energy costs as the amount of energy used to dry the fabric per unit decreases significantly.

According to one or more example embodiments, the inter-filament spaces in the fibrous structure 200, 300 may be in the form of capillaries that can be occupied by liquid. In general, these capillaries may be much better defined in continuous filament yarns under tension than in spun yarns, and liquid can wick into these structures spontaneously because of capillary pressure. Liquid transport phenomena in capillaries are mainly determined by pore (capillary) size distribution and their connectivity. The complex structural variables included pore sizes, pore size distribution, pore connectivity, and total pore volume. Pore structures in fibrous materials depend significantly on the fiber types and the methods of fiber assembly production. Fiber diameter, length, and shape, as well as fiber alignment may influence the quality of the capillary channels. Polyester filaments are continuous, cylindrical and considerably homogeneous in their sizes. Cotton fibers on the other hand, have highly irregular shapes as well as varying dimensions. These dimensional and shape differences are expected to affect fiber packing and pore quality. Therefore, it can be expected that capillaries structure would be different to some extent in core spun yarns 200, 300 which consist of polyester continuous filaments in core component 210, 310 and cotton fibers in sheath component 212, 312. This deduction may be made from the behavior of a liquid rise in the yarn 200, 300, for example. When yarn 200, 300 comes in contact with the colored liquid, no obvious difference would be observed in the liquid capillary rise height in both components of core 210, 310 and sheath 212, 312. This can be attributed to high capillary pressure in the beginning of liquid rise, which includes in the range of 50-60 sec from the initial contact of yarn 200, 300 with liquid. After a while, the difference in the liquid level height in the core 210, 310 and the sheath 212, 312 components can be observed due to the reduction in capillary pressure. In the core component 210, 310, capillaries formed by inter-filament spaces of polyester filaments may have a better quality and continuity than capillaries formed by inter-fiber spaces of cotton fibers 212, 312. This can be due to the continuity of polyester filaments, regular orientation of filaments, and less twist exertion on them than the cotton fibers in the sheath component of the yarn. Therefore, after 50-60 sec from the advancement of liquid into the yarn, the height of the liquid level in core component may be greater than in sheath component. However, after about 90 sec from the contact of the yarn with the colored liquid, differences of liquid level heights in the two components may be clearly perceptible. Although the above example embodiments refer specifically to yarn structures 200, 300, these references are purely exemplary, and a similar or better performance may be exhibited by structures in other example embodiments including 100, 400, and 500.

In order to maintain adequate tensile strength in the finished fabric, however, it may be necessary to use a polyester filament core yarn 210, 310 with a total denier of at least about 45 in both the warp and filling. However, to maintain the desired physical and aesthetic characteristics in the fabric, it may be necessary that the total denier not exceed about 60. In this regard, the percentage of staple fiber in the core spun warp and/or filling yarns may be kept to a level of at least about 60 percent to provide a sufficient amount of staple fiber to adequately cover the filament core. Within this yarn count range, a core spun sheeting fabric of at least about 120 total thread count or higher, for example, 160 threads per inch to about 400 threads per inch can be constructed while maintaining acceptable aesthetic qualities such as softness and suppleness, and acceptable physical standards such as physical strength, weight, and cover.

Unlike conventional sheeting fabric construction which normally has coarser warp yarns than filling yarns, the example embodiments disclosed preferably utilize warp and filling yarns of the same yarn count. The fabric may be woven so that when finished, the picks per inch may be approximately 10 to 20 percent less than the warp ends per inch. In one example embodiment, the textile structure may include core spun yarns in the range of about 40-60% by weight. In one example embodiment, the core spun yarns may include about 20% by weight polyester in the core portion and about 80% by weight of man-made, natural or blended sheath portion. In one example embodiment, the textile structure may include only polyester yarns in the weft direction. In another example embodiment, the textile structure may include only polyester yarns in warp direction, and the core spun yarns in the weft direction, either alone or in combination with polyester yarns or cotton yarns.

The textile structure may be a woven fabric sheeting or a pillowcase. The one or more layers of warp yarns and the one or more layers of weft yarns may include one or more core spun yarns. The warp yarns, the weft yarns, or the core spun yarns may have a yarn density of about 8 to 60 Ne. The warp yarns, the weft yarns, or the core spun yarns may include single or multiple ply yarns. The one or more core spun yarns may include a sheath portion and a core portion. The sheath portion may include natural yarns, man-made yarns, or blended yarns. The core portion may include natural yarns, man-made yarns, or blended yarns. The man made yarns may include filament yarns or core yarns. The filament yarns may include textured or un-textured yarns. The textile structure may also include, for example, a softener, a non-iron, an anti-microbial, an optical brightener, a flame retardant core, an anti-pilling agent, calendaring, a soil release agent, a water repellent, an anti-static treatment, or a heat setting treatment.

One example embodiment is a method for manufacturing a textile structure 100, 400, 500 including providing one or more layers of warp yarns, and weaving one or more layers of weft yarns with the one or more layers of warp yarns. At least one of the one or more layers of warp yarns and one or more layers of weft yarns include one or more core spun yarns. The one or more layers of warp yarns and the one or more layers of weft yarns may include one or more core spun yarns. The warp yarns, the weft yarns, or the core spun yarns may have a yarn density of about 8 to 60 Ne. The warp yarns, the weft yarns, or the core spun yarns may include single or multiple ply yarns. The one or more core spun yarns may include a sheath portion and a core portion. The sheath portion may include natural yarns, man-made yarns, or blended yarns. The core portion may include natural yarns, man-made yarns, or blended yarns. The man-made yarns may include filament yarns or core yarns. The filament yarns may include textured or un-textured yarns. The method may also include the operation of treating the textile structure with, for example, a softener, a non-iron, an anti-microbial, an optical brightener, a flame retardant core, an anti-pilling agent, calendaring, a soil release agent, a water repellent, an anti-static treatment, or a heat setting treatment.

FIG. 6 is a table comparing characteristics of an example core spun yarn, according to one or more example embodiments, with a spun polyester thread. As it may be seen from the table, core spun yarns have significantly higher yarn strength (lbs) when compared to spun polyester yarns. Similarly, fabrics made using the core spun yarns have significantly higher % elongation at break, and higher loop strength.

FIG. 7 is table comparing characteristics of an example core spun yarn with an intimate blend yarn, and a 100% cotton yarn, according to one or more example embodiments. The yarns in the fabric tested are around 36 Ne, which are used in the filling direction, and the warp yarns are around 50 Ne 100% cotton yarns in all three cases. As it may be seen from the table, core spun yarns have significantly higher yarn strength (kgf) when compared to an intimate blend or 100% cotton yarn. Similarly, fabrics made using the core spun yarns in the weft direction have significantly higher tensile break strength, higher tensile break elongation as well as tongue tear strength.

Some features of the above described example embodiments include increasing longevity of the sheeting and pillowcases, improving quality and comfort of the sheeting and pillowcases, and reducing operating expense for maintaining the sheeting and pillowcases by significantly reducing drying time and energy usage. Reduction in drying time may be a result of, for example, improved wickability and capillary rise in the polyester core of the core spun yarns.

One example embodiment provides sheeting fabrics and pillow cases having certain physical and aesthetic characteristics which are more luxurious than and superior to the characteristics of the fiber blend sheeting fabrics which are presently known. Another example embodiment can provide sheeting fabrics and pillow cases which more effectively utilize the beneficial properties of the core spun yarns as compared to conventional polyester and cotton blend fabric constructions so as to provide quick dry properties. This property may be specifically important in the hospitality industry as it may result in reduced drying time and reduced energy usage. Another example embodiment provides sheeting fabrics and pillow cases with high temperature resistance and better dimensional stability because of 100% cotton coverage on the surface of the fabric, which provides insulation to heat.

Another example embodiment provides sheeting fabrics and pillow cases with 100% cotton coverage on the surface of the fabric such that all the fibers that comes in contact with skin are cotton, giving the sheeting fabric a great feel and comfort. These and other embodiments can be accomplished by providing a unique sheeting fabric construction in which the core spun yarns are located at the surface of the fabric for improved hand with the cotton sheath of the core spun yarns being on the outside surface and improved physical characteristics with the polyester fibers being located in the core of the yarns to give strength and durability to the fabric.

While there have been shown, described and pointed out, fundamental novel features of the disclosure as applied to the example embodiments, it will be understood that various omissions and substitutions and changes in the form and details of examples illustrated, and in their operation, may be made by those skilled in the art without departing from the spirit of the disclosure. Moreover, it is expressly intended that all combinations of those elements and/or method operations, which perform substantially the same function in substantially the same way to achieve the same results, are within the scope of the disclosure. Moreover, it should be recognized that structures and/or elements and/or method operations shown and/or described in connection with any disclosed form or embodiment of the disclosure may be incorporated in any other disclosed or described or suggested form or embodiment as a general matter of design choice. It is the intention, therefore, to be limited only as indicated by the scope of the claims.

Example Embodiments

One example embodiment is a textile structure including one or more layers of warp yarns, and one or more layers of weft yarns interwoven with the one or more layers of warp yarns, wherein at least one of the one or more layers of warp yarns and one or more layers of weft yarns including one or more core spun yarns. The textile structure may be a woven fabric sheeting or a pillowcase. The one or more layers of warp yarns and the one or more layers of weft yarns may include one or more core spun yarns. The warp yarns, the weft yarns, or the core spun yarns may have a yarn density of about 8 to 60 Ne. The warp yarns, the weft yarns, or the core spun yarns may include single or multiple ply yarns. The one or more core spun yarns may include a sheath portion and a core portion. The sheath portion may include natural yarns, man-made yarns, or blended yarns. The core portion may include natural yarns, man-made yarns, or blended yarns. The man made yarns may include filament yarns or core yarns. The filament yarns may include textured or un-textured yarns. The textile structure may also include a softener, a non-iron, an anti-microbial, an optical brightener, a flame retardant core, an anti-pilling agent, calendaring, a soil release agent, a water repellent, an anti-static treatment, or a heat setting treatment. The drying rate of the textile structure can be at least 2.20 ml/hr or more, for example, at least 2.60 ml/hr. A breaking strength of the textile structure can be at least 110 lbf or more combined in both directions, for example, 150 lbf or more. A temperature resistance of the textile structure can be at least 300° F. or higher, for example, 350° F. The core to sheath ratio by weight can be at least 20:80. The tensile break strength of the one or more core spun yarns can be at least 40 kgf. A tensile break elongation of the one or more core spun yarns can be at least 20%. The sheath can provide partial or 100% coverage to the core. The warp yarns, the weft yarns, or the core spun yarns can have a yarn count between 8 and 60 Ne.

Another example embodiment is a method for manufacturing a textile structure including providing one or more layers of warp yarns, and weaving one or more layers of weft yarns with the one or more layers of warp yarns, wherein at least one of the one or more layers of warp yarns and one or more layers of weft yarns include one or more core spun yarns. The textile structure may be a woven fabric sheeting or a pillowcase. The one or more layers of warp yarns and the one or more layers of weft yarns may include one or more core spun yarns. The warp yarns, the weft yarns, or the core spun yarns may have a yarn density of about 8 to 60 Ne. The warp yarns, the weft yarns, or the core spun yarns may include single or multiple ply yarns. The one or more core spun yarns may include a sheath portion and a core portion. The sheath portion may include natural yarns, man-made yarns, or blended yarns. The core portion may include natural yarns, man-made yarns, or blended yarns. The man made yarns may include filament yarns or core yarns. The filament yarns may include textured or un-textured yarns. The method may also include treating the textile structure with a softener, a non-iron, an anti-microbial, an optical brightener, a flame retardant core, an anti-pilling agent, calendaring, a soil release agent, a water repellent, an anti-static treatment, or a heat setting treatment. The drying rate of the textile structure can be at least 2.20 ml/hr, for example, at least 2.60 ml/hr. A breaking strength of the textile structure can be at least 110 or more combined in both directions, for example, 150 lbf or more. A temperature resistance of the textile structure can be at least 300° F. or higher, for example, 350° F. The core to sheath ratio by weight can be at least 20:80. The tensile break strength of the one or more core spun yarns can be at least 40 kgf. A tensile break elongation of the one or more core spun yarns can be at least 20%. The sheath can provide partial or 100% coverage to the core. The warp yarns, the weft yarns, or the core spun yarns can have a yarn count between 8 and 60 Ne.

Another example embodiment is a woven fabric including a plurality of warp yarns, and a plurality of weft yarns interwoven with the plurality of warp yarns, wherein at least one of the plurality of warp yarns and the plurality of weft yarns include one or more core spun yarns. The one or more layers of warp yarns and the one or more layers of weft yarns may include one or more core spun yarns. The warp yarns, the weft yarns, or the core spun yarns may have a yarn density of about 8 to 60 Ne. The warp yarns, the weft yarns, or the core spun yarns may include single or multiple ply yarns. The one or more core spun yarns may include a sheath portion and a core portion. The sheath portion may include natural yarns, man-made yarns, or blended yarns. The core portion may include natural yarns, man-made yarns, or blended yarns. The man-made yarns may include filament yarns or core yarns. The filament yarns may include textured or un-textured yarns. The woven fabric may also include a softener, a non-iron, an anti-microbial, an optical brightener, a flame retardant core, an anti-pilling agent, calendaring, a soil release agent, a water repellent, an anti-static treatment, or a heat setting treatment. The drying rate of the fabric can be at least 2.20 ml/hr, for example, at least 2.60 ml/hr. A breaking strength of the fabric can be at least 110 lbf or more combined in both directions, for example, 150 lbf or more. A temperature resistance of the fabric can be at least 300° F. or higher, for example, 350° F. The core to sheath ratio by weight can be at least 20:80. The tensile break strength of the one or more core spun yarns can be at least 40 kgf. A tensile break elongation of the one or more core spun yarns can be at least 20%. The sheath can provide partial or 100% coverage to the core. The warp yarns, the weft yarns, or the core spun yarns can have a yarn count between 8 and 60 Ne.

What is claimed is:

1. A sheeting fabric comprising:

one or more layers of warp yarns; and one or more layers of weft yarns interwoven with the one or more layers of warp yarns, wherein the one or more layers of warp yarns consist essentially of core spun yarns and the one or more layers of weft yarns consist essentially of non-core spun yarns, wherein the core spun yarns consist essentially of a polyester filament core and a cotton sheath, and the non-core spun yarns consist essentially of polyester yarns, wherein the wefts per inch consisting essentially of the non-core spun yarns is 10-20 percent less than the warps per inch consisting essentially of the core spun yarns, wherein the non-core spun yarns are selected from spun yarns and filament yarns, wherein a total thread count of the sheeting fabric is between 120 and 400, wherein the sheeting fabric further comprises core spun yarns in the range of 50-60% by weight.

2. The sheeting fabric of claim 1, wherein a core to sheath ratio by weight of the core spun yarns is at least 20:80.

3. The sheeting fabric of claim 1, wherein a tensile break strength of the core spun yarns is at least 40 kgf.

4. The sheeting fabric of claim 1, wherein a tensile break elongation of the core spun yarns is at least 20%.

5. The sheeting fabric of claim 2, wherein the sheath provides 100% coverage to the core.

6. The sheeting fabric of claim 1, wherein the warp yarns, the weft yarns, or the core spun yarns have a yarn count between 8 and 60 Ne.

7. The sheeting fabric of claim 1, wherein the warp yarns, the weft yarns, or the core spun yarns comprise single or multiple ply yarns.

8. The sheeting fabric of claim 1, wherein the sheath portion comprises natural yarns, man-made yarns, or blended yarns.

9. The sheeting fabric of claim 8, wherein the man-made yarns comprise filament yarns or spun yarns.

10. The sheeting fabric of claim 9, wherein the filament yarns comprise texturized or non-texturized yarns.

11. The sheeting fabric of claim 1, wherein the core portion comprises natural fibers, man-made yarns, or blended yarns.

12. The sheeting fabric of claim 11, wherein the man-made yarns comprise filament yarns or spun yarns.

13. The sheeting fabric of claim 1, further comprising a softener, a non-iron, an anti-microbial, an optical brightener, a flame retardant core, an anti-pilling agent, calendaring, a soil release agent, a water repellent, an anti-static treatment, or a heat setting treatment.

14. A method for manufacturing a sheeting fabric, the method comprising:

weaving one or more layers of weft yarns with one or more layers of warp yarns, wherein the one or more layers of warp yarns consist essentially of core spun yarns and the one or more layers of weft yarns consist essentially of non-core spun yarns, wherein the core spun yarns consist essentially of a polyester filament core and a cotton sheath, and the non-core spun yarns consist essentially of polyester yarns, wherein the wefts per inch consisting essentially of the non-core spun yarns is 10-20 percent less than the warps per inch consisting essentially of the core spun yarns, wherein the non-core spun yarns are selected from spun yarns and filament yarns, wherein a total thread count of the sheeting fabric is between 120 and 400, wherein the sheeting fabric further comprises core spun yarns in the range of 50-60% by weight.

15. A woven fabric comprising:

a plurality of warp yarns; and a plurality of weft yarns interwoven with the plurality of warp yarns, wherein the plurality of warp yarns consist essentially of core spun yarns and the plurality of weft yarns consist essentially of non-core spun yarns, wherein the core spun yarns consist essentially of a polyester filament core and a cotton sheath, and the non-core spun yarns consist essentially of polyester yarns, wherein the wefts per inch consisting essentially of the non-core spun yarns is 10-20 percent less than the warps per inch consisting essentially of the core spun yarns, wherein the non-core spun yarns are selected from spun yarns and filament yarns, wherein a total thread count of the sheeting fabric is between 120 and 400, wherein the woven fabric further comprises core spun yarns in the range of 50-60% by weight.

16. The fabric of claim 15, wherein a tensile break strength of the core spun yarns is at least 40 kgf.

17. The fabric of claim 15, wherein a tensile break elongation of the core spun yarns is at least 20%.

18. The fabric of claim 15, wherein a core to sheath ratio by weight of the core spun yarns is at least 20:80.

19. The fabric of claim 15, wherein the warp yarns, the weft yarns, or the core spun yarns have a yarn count between 8 and 60 Ne.

20. The sheeting fabric of claim 1, wherein a drying rate of the sheeting fabric is at least 2.20 ml/hr.

21. The sheeting fabric of claim 1, wherein a breaking strength of the sheeting fabric is at least 110 lbf combined in both directions.

22. The sheeting fabric of claim 1, wherein a temperature resistance of the sheeting fabric is at least 300° F.

* * * * *